US006354197B1

(12) United States Patent
Bordignon et al.

(10) Patent No.: US 6,354,197 B1
(45) Date of Patent: Mar. 12, 2002

(54) DEVICE TO REMOVE COILS OF ROLLED STOCK FROM A CORRESPONDING COILING MACHINE

(75) Inventors: Giuseppe Bordignon, Bicinicco; Andrea De Luca, Remanzacco; Alfredo Poloni, Fogliano di Redipuglia, all of (IT)

(73) Assignee: Danieli & C. Officine Meccaniche SpA, Buttrio (IT)

( * ) Notice: Subject to any disclaimer, the term of this patent is extended or adjusted under 35 U.S.C. 154(b) by 0 days.

(21) Appl. No.: 09/432,151

(22) Filed: Nov. 2, 1999

(30) Foreign Application Priority Data

Nov. 4, 1998 (IT) ..... UD98A0188

(51) Int. Cl.[7] ..... B65B 27/06

(52) U.S. Cl. ..... 100/7; 100/12; 100/14; 414/684

(58) Field of Search ..... 100/12, 14, 7, 100/99; 414/684

(56) References Cited

U.S. PATENT DOCUMENTS

| | | | | |
|---|---|---|---|---|
| 2,336,614 A | * | 12/1943 | Jackson | 100/12 X |
| 2,776,764 A | | 1/1957 | Palmleaf | |
| 3,123,236 A | | 3/1964 | Contaldo | |
| 3,139,024 A | * | 6/1964 | Laine | 100/7 |
| 3,598,251 A | | 8/1971 | Sieurin | |
| 4,301,720 A | * | 11/1981 | Elineau | 100/14 X |
| 4,807,350 A | * | 2/1989 | Hasenkamp | 100/14 X |
| 5,332,351 A | | 7/1994 | Nelson et al. | |
| 5,544,828 A | | 8/1996 | Winkler et al. | |

FOREIGN PATENT DOCUMENTS

| | | |
|---|---|---|
| DE | 3404893 | 8/1985 |
| EP | 0444311 | 9/1991 |

OTHER PUBLICATIONS

Patent Abstracts of Japan, vol. 9, No. 172, Jul. 17, 1985 for JP 60044471, published Mar. 9, 1985.

Patent Abstracts of Japan, vol. 8, No. 270, Aug. 14, 1984 for JP 59141317, published Aug. 14, 1984.

* cited by examiner

*Primary Examiner*—Stephen F. Gerrity
(74) *Attorney, Agent, or Firm*—Stevens, Davis, Miller & Mosher, LLP

(57) ABSTRACT

A device to remove coils of rolled stock from a corresponding coiling machine located downstream of a rolling train is disclosed. The coiling machine includes a mandrel mounted to be rotatable around an axis of rotation. The device includes a coil remover and an actuator. The coil remover is associated with the coiling machine and is movable in a direction substantially parallel to the axis of rotation between a first inactive position, in which the device to remove coils is arranged outside the space occupied by the coiling machine, and a first working position, in which the coil remover cooperates with the coil of rolled stock formed by the coiling machine. The actuator is suitable to move the coil remover between the first inactive position and the first working position and vice versa.

6 Claims, 3 Drawing Sheets

DEVICE TO REMOVE COILS OF ROLLED STOCK FROM A CORRESPONDING COILING MACHINE

FIELD OF THE INVENTION

This invention concerns a device to remove coils of rolled stock from a corresponding coiling machine.

To be more exact, the device is suitable to remove coils of rolled stock such as bars, plate, or rods (smooth or ribbed) of hot-rolled metal material, with a cross-section either round, square, rectangular, hexagonal or otherwise.

The device according to the invention is placed downstream of a traditional rolling train, provided with a precision coiling machine, that is to say, of the type wherein the individual spirals are formed under the guidance of mechanical means which regulate their packing, density and tension.

BACKGROUND OF THE INVENTION

The state of the art covers a device to remove coils of rolled stock associated with a rolling train wherein each coil of rolled stock, coiled by a coiling machine on a vertical axis, is removed by a first trolley which, keeping the coil vertical, lifts it and carries it to a second trolley used to transport and convey the coil.

This device has the disadvantage that it cannot be used to remove and move coils formed on coiling machines with a horizontal axis of rotation, since it has no means suitable to perform this movement.

The present applicant has designed, tested and embodied this invention to overcome the shortcomings of the state of the art and to obtain further advantages.

SUMMARY OF THE INVENTION

The main purpose of the invention is to achieve a device to remove coils of rolled stock wherein the coil formed in the coiling machine can be removed without unravelling the spirals and without damaging the outer layers, and wherein it is possible to transport the coil to a tying station first and to a weighing and storing station later both quickly and safely.

In accordance with this purpose, the device according to the invention comprises means to remove the coil, which are associated with the coiling machine and are movable, in a direction substantially parallel to the axis of rotation thereof, between a first inactive position, wherein they are arranged outside the space occupied by the coiling machine itself, and a first working position, wherein they cooperate with the coil of rolled stock to remove it and move it. Actuation means are also provided to move the removal means from the inactive position to the first working position and vice versa.

It is thus possible to remove and move coils of rolled stock which are even very heavy, in the order of several tonnes, in rolling lines with an hourly production in the order of 100–110 tonnes per hour.

A second purpose of the invention is to achieve a device to remove and move coils of rolled stock wherein each coil is maintained compact during the removal and movement steps.

BRIEF DESCRIPTION OF THE DRAWINGS

These and other characteristics of the invention will become clear from the following description of a preferred form of embodiment, given as a non-restrictive example with the aid of the attached drawings wherein.

DETAILED DESCRIPTION OF PREFERRED EMBODIMENT

Figure 1:
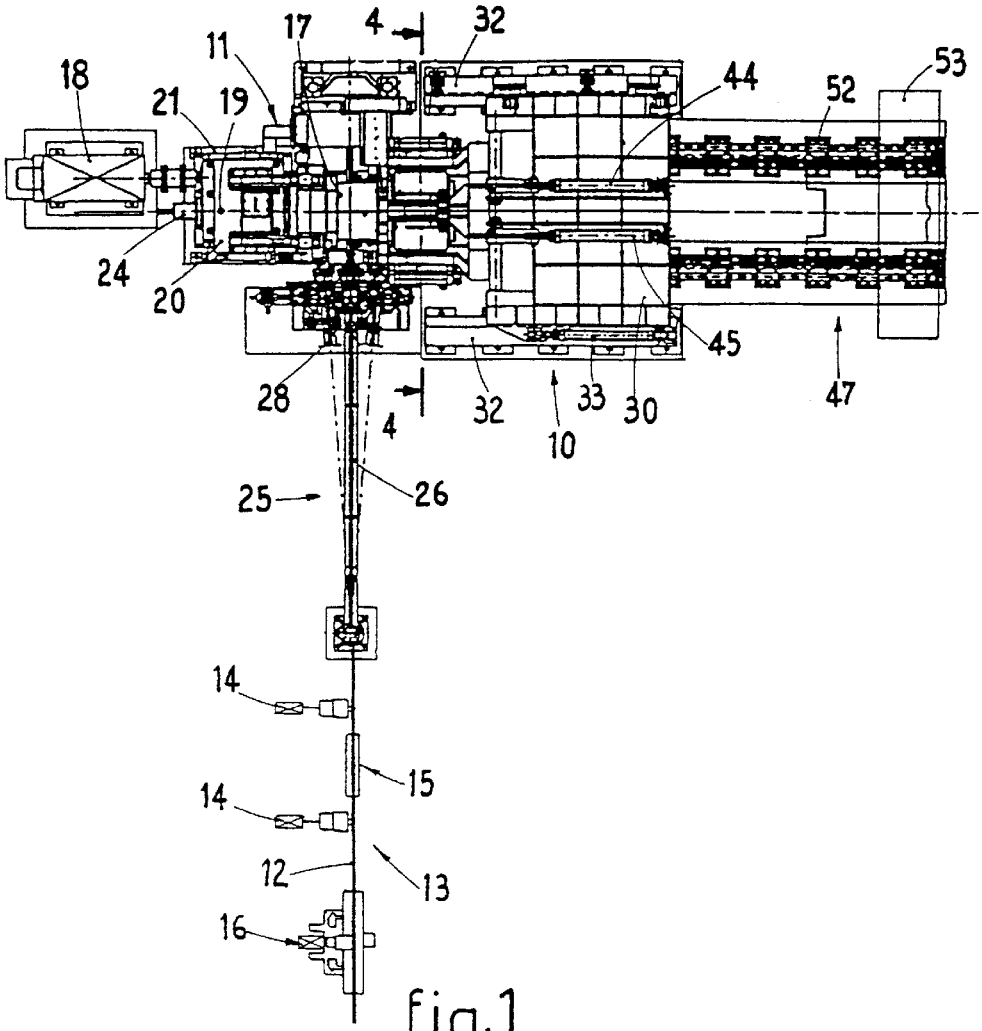
FIG. 1 is a view from above of the device to remove and move coils of rolled stock according to the invention.

With reference to FIG. 1, a device 10 according to the invention is arranged next to a coiling machine 11, to remove and move coils of rolled stock 12 coiled by the latter.

In turn the coiling machine 11 is located downstream of a hot rolling train 13 suitable to produce rolled stock 12 such as bars, plate, or rods (smooth or ribbed) of metal material, with a cross-section either round, square, rectangular, hexagonal or otherwise.

The rolling train 13 can be of any known type, comprising drawing rollers 14, a loop-forming device 15 and a shears 16 suitable to shear to size the rolled stock 12 to be coiled.

The looper 15 is suitable to regulate the flow of rolled stock 12 towards the coiling machine 11 and to make it correctly perform the increase in diameter step, during the same coiling operation. The looper 15 thus fulfils a function of a buffer for the rolled stock 12 before it is coiled.

Figure 3:
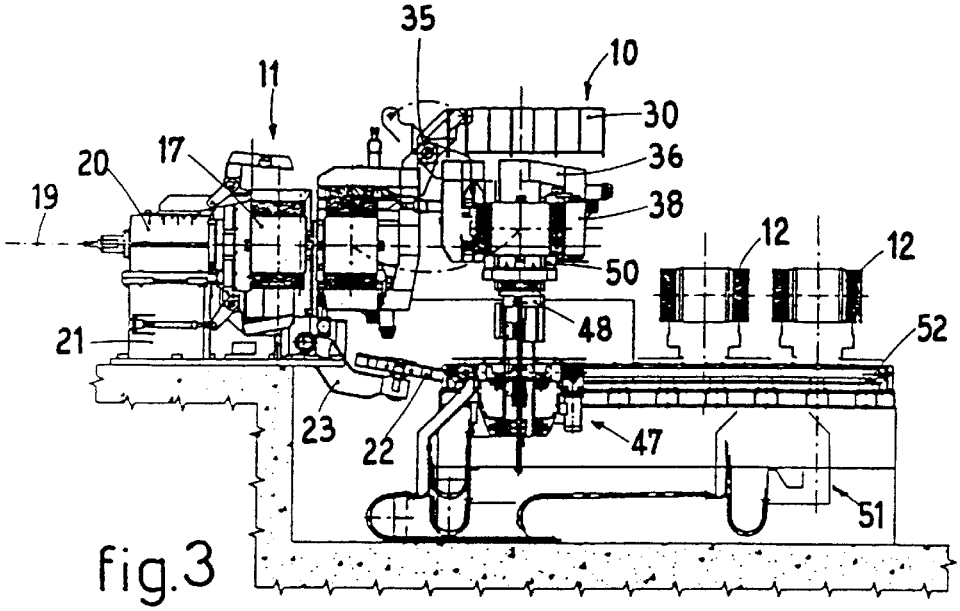
FIG. 3 is a front view of the device shown in FIG. 1 in a second working position.

The coiling machine 11 is of the precision type, that is to say, the type wherein the individual spirals are formed under the guidance of mechanical means which regulate the packing, the density and the tension; it comprises a mandrel or reel 17 with a horizontal axis of rotation 19 (FIG. 3), mounted cantilevered and rotatable on a vertical turret 20 of a stationary metallic structure 21, driven by an electric motor 18.

A cylindrical containing plate 22 is suitable to cooperate with the outer end of the mandrel 17; the cylindrical plate 22 is mounted rotatable and cantilevered on one end of an arm 23, the other end of which pivots on the stationary structure 21.

The cylindrical plate 22 can move between a working position (FIG. 2), wherein it is arranged substantially orthogonal to the axis of rotation 19 of the mandrel 17 and cooperating therewith, and an inactive position, or position wherein the coil is removed (FIG. 3), wherein it is arranged substantially horizontal, distanced from the mandrel 17 and lowered with respect thereto.

The mandrel 17 is formed by four retractable elements, movable radially so as to facilitate the removal of the just-formed coil of rolled stock 12. The radial movement of the four elements is obtained with a hydraulically commanded and water cooled mechanism 24.

Between the looper 15 and the coiling machine 11 there is a device to distribute the spirals 25 (FIG. 1), comprising a tubular guide 26, about 5.5 metres long and with one end 28 movable both horizontally and vertically.

In the inactive position the tubular guide 26 lies on a plane substantially horizontal and tangent to the outer cylindrical surface of the mandrel 17.

Figure 4:
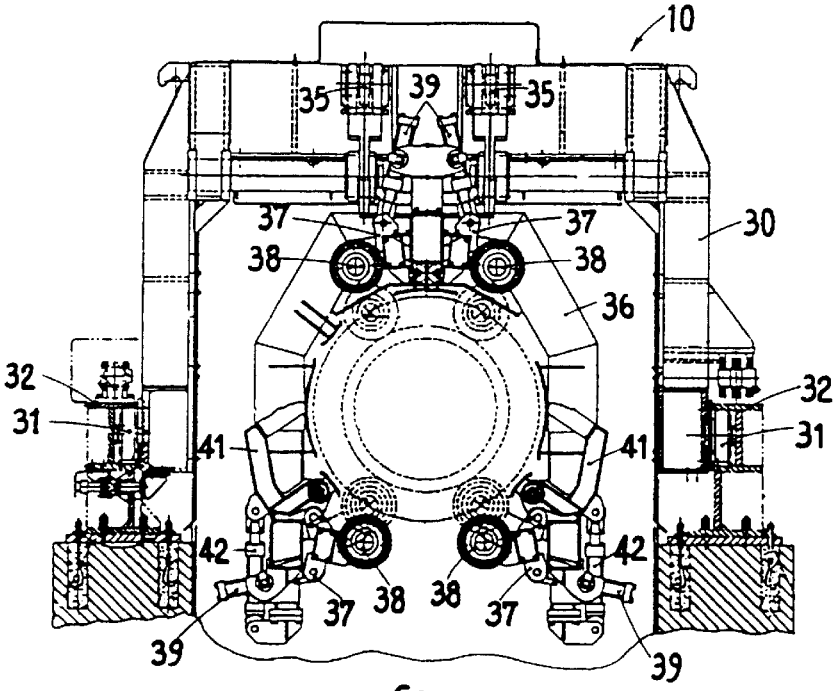
FIG. 4 is a left side view, enlarged and partly in section along a line from 4—4 of FIG. 1.
Figure 5:
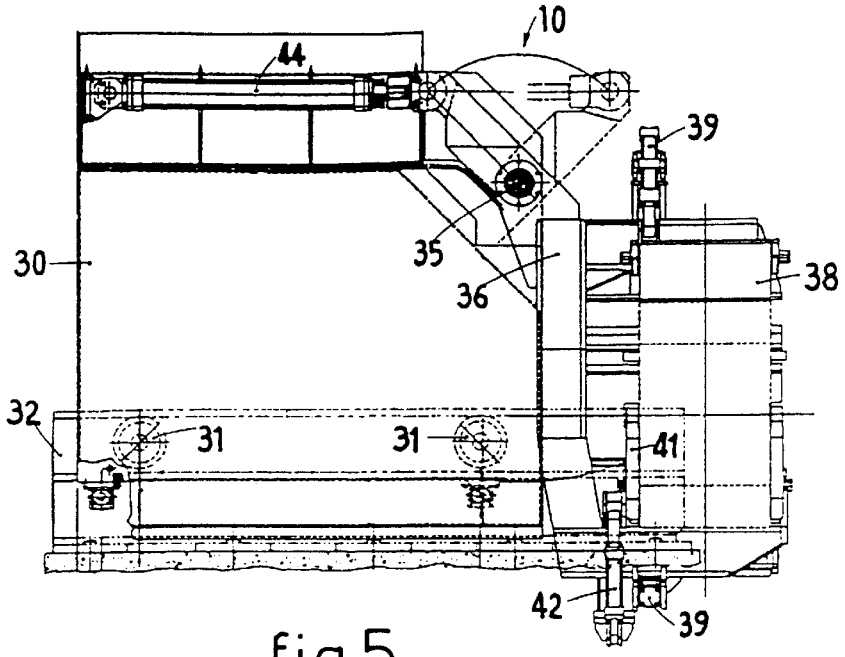
FIG. 5 is a view from behind of an enlarged detail of the device in FIG. 1.
Figure 6:
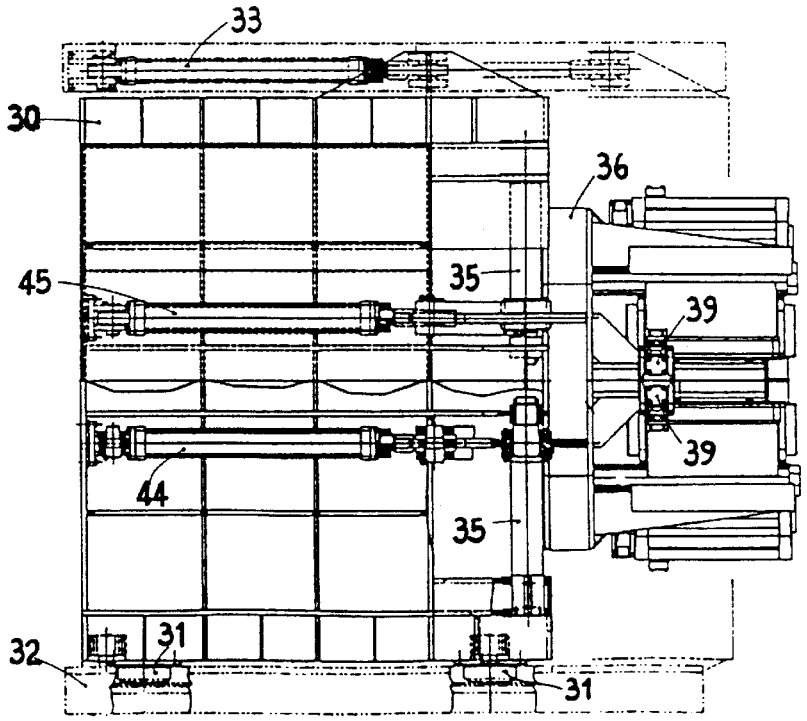
FIG. 6 is a view from above of the detail shown in FIG. 5.

The device 10 also comprises a trolley 30 provided with wheels 31 (FIGS. 4–6) sliding on fixed rails 32, arranged parallel to the axis of rotation 19 and commanded by an actuator 33 of a hydraulic type.

A supporting frame 36 pivots on transverse pins 35 of the trolley 30; in turn, four levers 37 pivot on the supporting frame 36 and are arranged substantially at 90° with respect to each other; at the end of each of the four levers 37 a corresponding idler roller 38 is mounted rotatable.

The four rollers 38 have their axes of rotation parallel to each other, and are suitable to cooperate with the trailing end of the rolled stock 12 to prevent the spirals from unravelling and to keep the coil compact.

The four levers 37 are commanded by corresponding hydraulic actuators 39 to displace the rollers 38 radially.

Two fork-type levers 41 pivot on the frame 36 and are suitable to be actuated by corresponding hydraulic actuators 42.

Two hydraulic actuators 44 and 45, mounted on the upper part of the trolley 30, are suitable to command the rotation by 90° of the supporting frame 36 between a first working position (FIG. 2) wherein the axes of the rollers 38 are horizontal and parallel to the axis of rotation 19 of the mandrel 17, so as to execute the step of gripping and removing the coil of rolled stock, and a second working position (FIG. 3) wherein the axes of the rollers 38 are substantially vertical, so as to execute the step of releasing each coil of rolled stock 12 formed on the coiling machine 11, after the coil has been overturned through 90°.

The device 10 also comprises an assembly 47 to transport the coils which comprises a bench 49 movable vertically and commanded hydraulically. The bench 49 is provided with four movable grippers 50, also commanded hydraulically, which are suitable to grip the coil supported by the fork-type levers 41 of the frame 36, with the axis in the vertical position, to prevent the coil from unravelling, and hold it until it reaches the tying step.

The coil transport assembly 47 also comprises a tying and strapping station 51, wherein the coils of rolled stock 12 are tied in a known manner. The bench 49 is also able to rotate on itself through 90°, together with the coil which it is carrying, so that the tying station 51, although it has only two tying machines, one opposite the other, is able to perform at least four tying operations for each coil.

The coil transport assembly 47 also comprises a chain transporter 52, provided with a weighing bascule 53 to weigh the coils.

Figure 2:
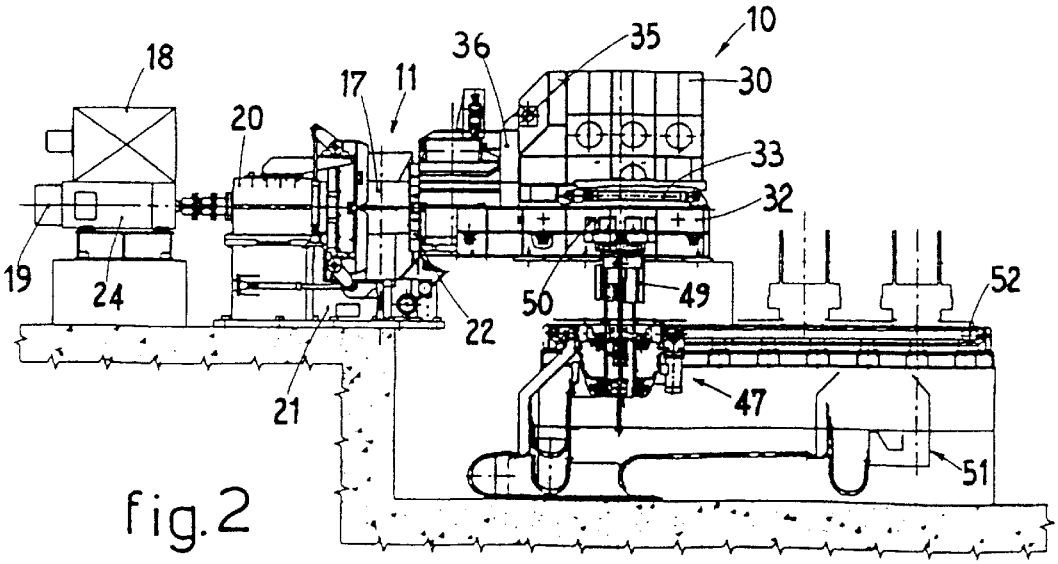
FIG. 2 is a front view of the device shown in FIG. 1 in a first working position.

The transporter 52 is suitable to discharge and store the coils of rolled stock 12 formed on the coiling machine 11. The device 10 as described heretofore functions as follows:

In the inactive position the trolley 30 is outside the space occupied by the coiling machine 11, which is prepared to receive the rolled stock 12 to be coiled. To be more exact, the cylindrical plate 22 is positioned in contact with the outer end of the mandrel 17 (FIG. 2).

The mandrel 17 and with it the cylindrical plate 22 is made to rotate by the motor 18.

The rolled stock 12 arriving from the rolling train 13 (FIG. 1) is drawn by the drawing rollers 14 at a very high speed, more than 40 metres per second, towards the coiling machine 11 and the device 25 to distribute the spirals guides the leading end of the rolled stock 12 towards the mandrel 17.

The rollers 14 of the looper 15 guarantee that the rolled stock 12 is kept under tension and that it is coiled under traction onto the mandrel 17 of the coiling machine 11. They also form the loop needed to accumulate rolled stock 12 to be supplied quickly to the coiling machine 11 as the diameters of the coil are increased during the same coiling cycle. The drawing rollers 14 brake the trailing end of the rolled stock 12, to keep it at the desired tension when the mandrel 17 decelerates and stops at the end of the coiling step.

The rolled stock 12 is then guided by the tubular guide 26 which is displaced horizontally, backwards and forwards and upwards, at the end of every ring of spirals. It is thus possible to obtain a rational and controlled distribution of the spirals both on every single ring and also on the different coaxial rings which form the coil.

Layer after layer, or ring after ring, the coil is formed until the rolled stock 12 has been completely coiled.

The shears 16 is commanded to shear to size the rolled stock 12 which is coiling on the coiling machine 11, in such a way that the dimensions and weight of the coil are predefined.

While the last spirals are forming, the motor 18 is rapidly decelerated, so that the mandrel 17 stops in a very short time.

During this deceleration step, when the speed of rotation is low and before the trailing end of the rolled stock 12 emerges from the drawing rollers 14 located immediately upstream of the spiral distributor 25, the cylindrical plate 22 is distanced from the mandrel 17 and the actuator 33 is actuated, so that the trolley 30 is taken towards the mandrel 17, with its four idler rollers 38 coaxial to the coil which is just being completed.

The actuators 39 are actuated so that the rollers 38 close on the still-rotating coil and thus prevent the last spirals of the coil from unravelling. In this way the rollers 53 also collaborate in the final step of coiling the trailing end of the coil, and thus maintain the coil compact.

When the motor 18 has completely stopped and the coil of rolled stock 12 is stationary, the actuators 42 are actuated to take the fork-type levers 41 to be inserted between the coil and the vertical turret 20, both to remove the coil and also to ensure that the coil is supported while it is removed and rotated by 90°.

The trolley 30 is then translated horizontally towards its starting position (FIG. 2) so that the coil is removed horizontally from the mandrel 17, which at the same time retracts radially to facilitate the removal of the coil.

The actuators 43 and 45 are then actuated to make the support 36 rotate by 90°, together with the coil which is attached thereto, in such a way as to take the coil itself above the bench 49 which is already prepared in a raised position.

The grippers 50 grip the coil of rolled stock 12 to prevent it from unravelling. The bench 49 is made to descend and is displaced towards the tying and strapping station 51 where the coil is tied.

The chain transporter 53 then provides to transport the coil towards the weighing bascule 56 and subsequently to a storage zone where it may be moved further.

It is obvious that modifications and additions may be made to the device to remove and move coils of rolled stock coiled by a corresponding coiling machine as described heretofore, but these shall remain nonetheless within the spirit and scope of the invention.

What is claimed is:

1. A device to remove coils of rolled stock from a coiling machine located downstream of a rolling train and having a mandrel mounted rotatable around an axis of rotation, the device comprising:

removal means to remove the coil from the coiling machine, said removal means being movable in a direction substantially parallel to said axis of rotation of said mandrel between a first inactive position, wherein the removal means is arranged outside the space occupied by said coiling machine, and a first working position, wherein the removal means cooperates with said coil of rolled stock formed by said coiling machine, actuation means to move said removal means between said inactive position and said first working position and vice versa, wherein said removal means comprises a trolley mounted sliding on fixed guide elements parallel to said axis of rotation of said mandrel, a supporting frame mounted on said trolley, a plurality of rollers mounted on said supporting frame with axes of rotation of the rollers substantially parallel to said axis of rotation of said mandrel and cooperating with said coil to prevent the spirals of the rolled stock from unwinding, a plurality of supporting levers mounted on said supporting frame for being positioned, transversely to said coil of rolled stock, for selectively cooperating with said coil of rolled stock for executing the axial removal of said coil from said mandrel when said trolley and said supporting frame mounted thereon are moved from said first working position to said first inactive position.

2. A device as in claim 1, further comprising means for rotating said supporting frame, wherein said axis of rotation of said mandrel lies on a substantially horizontal plane, and wherein said supporting frame is pivotally mounted on said trolley so as to rotate substantially by 90° when said removal means are in the inactive position and correspondingly to take the coil of rolled stock from a first position with a horizontal axis to a second position with a vertical axis.

3. A device as in claim 1, further comprising a transport assembly for transporting said coil from said removal means to a tying and strapping station.

4. A device as in claim 3, wherein said transport assembly comprises a vertically movable bench provided with a plurality of movable grippers for gripping said coil supported by said supporting levers with the axis of said coil in a vertical position, to prevent said coil from unwinding.

5. A device as in claim 4, wherein said bench comprises bench rotating means, wherein the bench together with the coil supported by said bench are rotatable, so that said tying and strapping station is able to perform at least two tying operations for each of said coils with the same tying machine.

6. A device as in claim 1, wherein lifting means are provided downstream of the removal means to lift and weigh said coil.

* * * * *